United States Patent [19]

Fishburne

[11] Patent Number: 4,457,125

[45] Date of Patent: Jul. 3, 1984

[54] PRESS FOR PACKING COMPRESSIBLE MATERIAL HAVING AN AIR RELEASE SLEEVE

[76] Inventor: Francis B. Fishburne, P.O. Box 706, Arden, N.C. 28704

[21] Appl. No.: 487,732

[22] Filed: Apr. 22, 1983

[51] Int. Cl.[3] ..... B65B 1/24; B65B 1/28

[52] U.S. Cl. ..... 53/527; 53/510; 141/80; 141/114

[58] Field of Search ..... 53/527, 523, 510; 141/73, 80, 71, 12, 10, 114, 313–317

[56] References Cited

U.S. PATENT DOCUMENTS

| | | | |
|---|---|---|---|
| 1,993,442 | 3/1935 | Greven | 53/510 |
| 2,815,621 | 12/1957 | Carter | 53/527 X |
| 2,954,730 | 10/1960 | Moser | 100/215 |
| 2,984,172 | 5/1961 | Roberts et al. | 53/523 X |
| 3,252,737 | 4/1966 | Seaton | 297/462 |
| 3,254,467 | 6/1966 | Garrow et al. | 53/527 X |
| 3,377,945 | 4/1968 | Davis | 141/80 X |
| 3,405,744 | 10/1968 | Bowman | 53/527 X |
| 3,595,282 | 7/1971 | Fishburne et al. | 141/73 |
| 3,641,734 | 2/1972 | Fishburne | 53/527 |
| 3,675,570 | 7/1972 | Mersfelder | 100/90 |
| 3,817,298 | 6/1974 | Fishburne | 141/80 |
| 3,908,720 | 9/1975 | Garnett | 141/93 |
| 3,968,619 | 7/1976 | Fishburne | 53/24 |
| 4,108,063 | 8/1978 | Randolph | 100/53 |

*Primary Examiner*—James F. Coan

*Attorney, Agent, or Firm*—Roylance, Abrams, Berdo & Goodman

[57] ABSTRACT

A press for packing loose compressible material, such as tobacco, into rectangular cases or cylindrical hogsheads. The press includes a charger for delivering the material into the container and a pressing ram movable through the charger to pack the material into the container. The bottom of the charger, which is receivable in the container, comprises a double-walled sleeve, the inner wall being perforated and the outer wall being imperforated. An air conducting channel is defined between the walls which communicates with a manifold at the top of the sleeve. This manifold is connected to a pump to draw air out of the sleeve, up the channel and into the manifold. Use of the sleeve creates a negative pressure in the sleeve so that atmospheric pressure, exerted on the top of the loose material in the charger, will reduce the height of the material in the charger and thus allows use of shorter chargers, rams and cycle times, as well as reducing dust. The charger can have an additional double-walled section above the bottom sleeve to provide further reduction in the height of the loose material.

24 Claims, 11 Drawing Figures

PRESS FOR PACKING COMPRESSIBLE MATERIAL HAVING AN AIR RELEASE SLEEVE

FIELD OF THE INVENTION

The invention relates to a press for packing loose compressible material, such as tobacco, into containers. The press includes a charger for delivering the material into the container and a pressing ram movable through the charger to pack the material into the container. The bottom of the charger is receivable in the container and perforated and has an air conducting assembly for drawing air out of the charger and conducting it out of the container. This creates a negative pressure in the charger, thereby allowing atmospheric pressure exerted on the top of the column of material in the charger to reduce the height of the column, and thus allows use of shorter chargers, rams and cycle times.

BACKGROUND OF THE INVENTION

Presses for packing loose, compressible material, such as tobacco, are well known in the art such as those disclosed in U.S. Pat. Nos. 3,595,282, 3,641,734 and 3,817,298. These presses can pack the material into rectangular cases or cylindrical hogsheads. They typically include an open ended hollow, vertically oriented charger for delivering the material into the container, which is positioned below the charger, and for supporting a column of the material extending upwardly from the container. Also included is a pressing ram movable through the charger to pack the material in the charger into the container.

Due to the high forces generated by the downwardly moving pressing ram compressing the material, as well as the pneumatic pressure created by compressing entrained air in the charger, a reinforcing device is typically used on the inside or outside of the container to prevent the container's outward collapse.

However, numerous problems have plagued these prior art devices that reinforce the container. For example, they are costly and complicated to manufacture and those used on the inside of the container tend to scar the material or break under the high compressive forces encountered under repeated use.

There has also been a continued need to decrease the cycle time of such presses, reduce their vertical height which is costly from manufacturing and space standpoints, simplify the infeed conveying organization for the material and reduce the amount of dust generated during the packing of the material.

Thus, there is continuing need for improvement in such presses for packing compressible material, such as tobacco.

Examples of the prior art devices discussed above are disclosed in U.S. Pat. Nos. 2,954,730 to Moser; 2,984,172 to Roberts et al; 3,405,744 to Bowman; 3,595,282 to Fishburne et al; and 3,641,734 and 3,817,298 to Fishburne.

SUMMARY OF THE INVENTION

Accordingly, a primary object of the invention is to provide a press for packing, loose compressible material that provides an effective reinforcing device for the container being packed, this device being simple to construct and use.

Another object of the invention is to provide such a press for packing loose, compressible material that utilizes an air release sleeve as the reinforcing device that can draw air out of the charger and collect it to thereby reduce dust, provide a faster loading press with a shorter pressing ram and charger, which in turn takes up less space, uses less structural material and simplifies infeed conveying organization.

Another object of the invention is to provide a press for packing loose, compressible material with a reinforcing device that can absorb repeated high pressures due to compaction without failure.

Another object of the invention is to provide such a press that has a reinforcing device for the container that is compatible with packing tobacco and thus avoids scaring of the packed material.

The foregoing objects are basically attained by providing in a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising an assembly, coupled to the sleeve and activated when the sleeve is within the container, for conducting air transversely from inside of the sleeve, upwardly longitudinally of the sleeve but not in contact with the sides of the container, and then outwardly away from the sleeve above the sides of the container.

Advantageously, the air conducting assembly comprises a double-walled sleeve, the inner wall being smooth and perforated and the outer wall being imperforated. An air conducting channel is defined between the walls which communicates with a manifold at the top of the sleeve. This manifold is connected to a pump to draw air out of the sleeve, up the channel and into the manifold. Use of the sleeve creates a negative pressure in the charger, thereby allowing atmospheric pressure on the loose material to push it down the charger in advance of compaction by the press head and thus allows use of shorter chargers and rams, a faster cycling time and reduces dust.

The charger can have an additional double-walled section above the bottom sleeve to provide an additional negative pressure area to further reduce the height of the material in the charger.

Other objects, advantages and salient features of the invention will become apparent from the following detailed description which, taken in conjunction with the annexed drawings, discloses preferred embodiments of the invention.

DRAWINGS

Referring now to the drawings which form a part of the original disclosure:

DETAILED DESCRIPTION OF THE INVENTION

Figure 1:
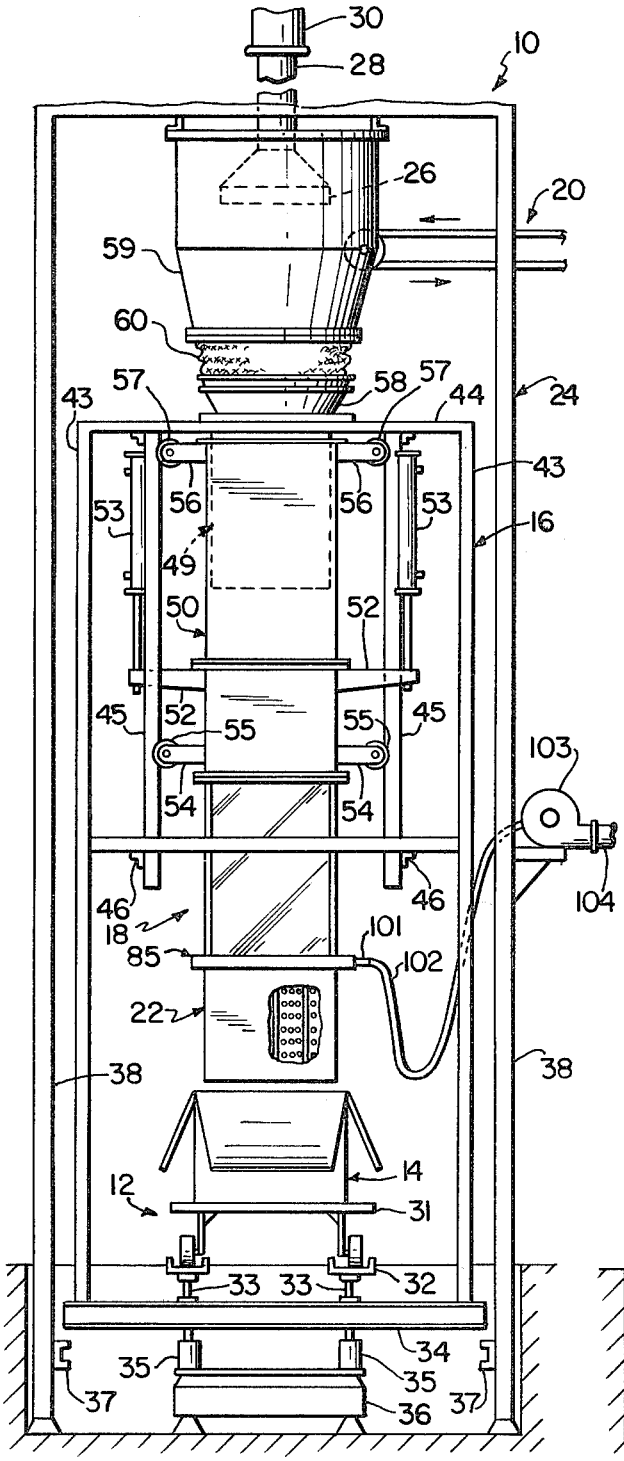
FIG. 1 is a front elevational view of the press in accordance with the invention for packing compressible material into a rectangular case, the air release sleeve being shown without the case.

Referring now to FIGS. 1-7, the press 10 in accordance with the invention comprises a support frame 12 for supporting the rectangular container 14 to be packed with leaf tobacco or the like, a weighing frame 16, a charger 18 to which the tobacco is supplied by an infeed conveyor 20 and in which the tobacco forms a column, and an open-ended air release sleeve 22 coupled to the bottom of the charger. The air release sleeve is vertically movable with a lower part of the charger and is thus located within the container when the lower charger is in the lower position and without the container when the lower charger is in the upper position. The sleeve has transverse dimensions slightly smaller than those of the container but a cross section similar to that of the container. The air release sleeve includes an assembly for conducting air transversely from the inside of the sleeve, upwardly longitudinally of the sleeve but not in contact with the sides of the container and then outwardly away from the sleeve above the sides of the container. This assembly is activated when the sleeve is within the container to create a negative pressure in the sleeve so that atmospheric pressure will reduce the height of the tobacco column in the charger and thus allow use of shorter chargers, rams and cycle times, as well as reducing dust.

The press 10 further includes a main frame 24, a vertically reciprocating press head 26 carried by a vertical pressing ram 28, and a hydraulic cylinder 30 for receiving and driving the pressing ram downwardly to effect a pressing stroke and returning the ram upwardly to return the press head to its initial position, this movement being through the charger.

The support frame 12 comprises a dolly 31 which, during operation of the press, is disposed with its wheels in tracks 32 supported respectively by two horizontal beams 33 which extend across and are secured to the horizontal base members 34 of the weighing frame 16. The entire weighing frame is supported by four upright hydraulic power devices 35. The cylinders of the power devices 35 are rigidly mounted on a base 36 and the piston rods thereof act upwardly on the combination of beams 33 and base members 34 when the power devices are energized. When the power devices are deenergized, the combination of beams 33 and base members 34 is allowed to descend a small distance to bring the members 34 into seating engagement with a pair of horizontal support beams 37 which are rigidly mounted on the uprights 38 of the main frame 24. When members 34 engage beams 37, the combination of members 34 and beams 33 is secured against downward movement and accordingly the dolly 31 is supported to accept the downward force applied thereto as the press head operated to press the tobacco into the container 14. A conventional weighing mechanism, not shown, responds through suitable lever means to the weight of the weighing frame 16, the support frame 12 and container 14 when power devices 35 are operated to raise beams 33.

Container 14 is typically a shipping case or box of elongated rectangular plan and side elevational configuration, with an open top defined by four upright side walls 40 and with a bottom wall 41.

Weighing frame 16 includes four upright frame members 43 and horizontal top members 44 with the frame being rectangular in side elevation and in top plan elevation. Two vertical track members 45 are secured to and depend from the top structure of the weighing frame, the two track members being spaced apart across the charger and lying in a vertical plane which is parallel with the larger sides of the charger and which extends through the center of the charger structure. The lower ends of the track members are secured to horizontal cross braces 46, these braces being rigid portions of the weighing frame.

The charger is in the nature of an upright hollow open-ended assembly comprising an upper charger 49 and a lower charger 50. The upper and lower chargers are of rectangular transverse cross section conforming generally to the rectangular plan configuration of container 14, which is supported on dolly 31 below the bottom open end of the lower charger.

Figure 2:
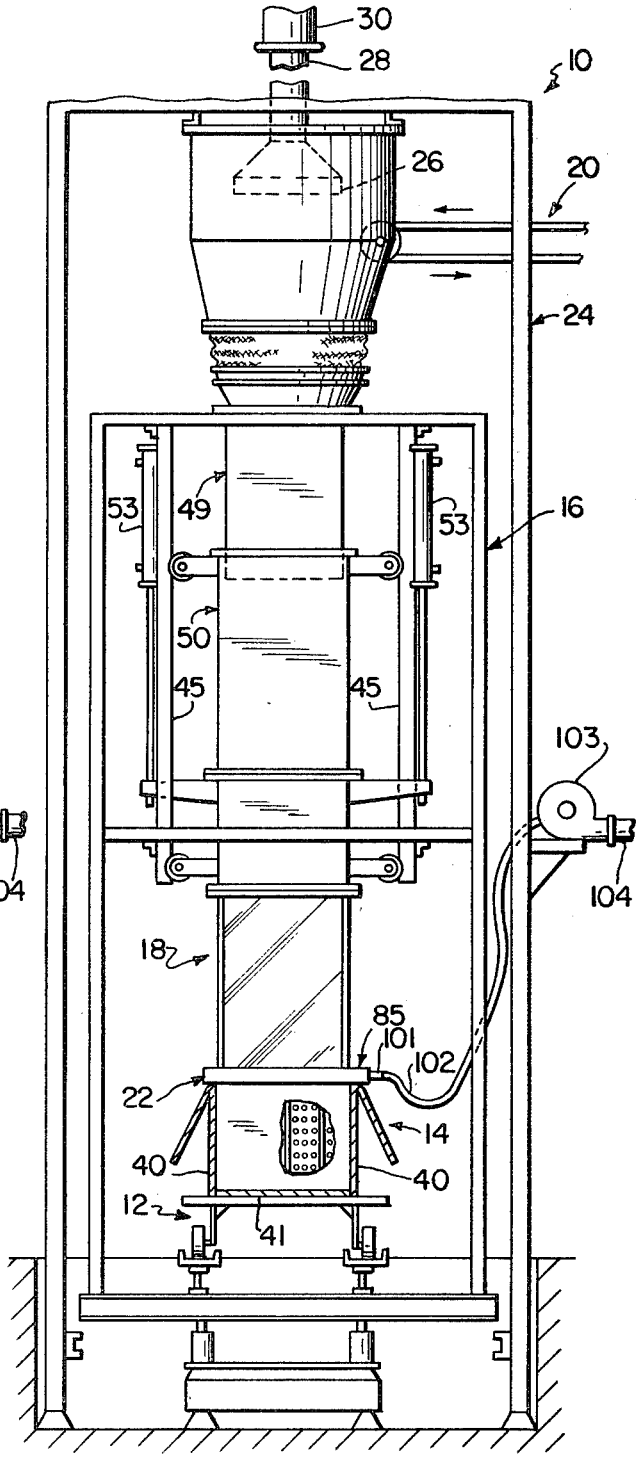
FIG. 2 is a front elevational view similar to that shown in FIG. 1 except that the charger has been lowered so that the air release sleeve is located within the case.

Rigidly secured to the lower charger 50 are a pair of transversely aligned laterally projecting arms 52. Two rectilinear acting power devices 53 are mounted on the weighing frame 16 by being secured each to a different one of the track members 45 so that the power devices are each located at a different side of the lower charger 50, the two power devices 53 being vertically aligned respectively above the outer end portions of arms 52. The power devices are identical and each comprise a hydraulic cylinder fixed to the weighing frame and a piston rod having its outer end fixed to one of the arms 52. These power devices are operative to selectively raise and lower the lower charger 50 independently of the weighing frame and pressing ram to place the air release sleeve 22 within the container as shown in FIG. 2 or without the container as shown in FIG. 1.

Two transversely aligned laterally outwardly projecting wheel supports 54 are rigidly secured to the lower charger and each are equipped with a wheel 55 adapted to engage one of the track members 45. Similarly, two upper wheel supports 56 are secured to the top of the lower charger 50 and each are equipped with a wheel 57 for engagement of the respective ones of the track members 45. Wheel supports 54 and 56 are vertically aligned in a common plane which extends through the longitudinal axis of the lower charger. One power device 53 and its cooperating arm lie in a vertical plane spaced in front of the respective track member 45, the other power device and arm being disposed behind the respective track member.

Carried by the top structure of the weighing frame 16 is a lower funnel 58 which communicates with the upper charger 49. As seen in FIGS. 1 and 2, the upper charger 49 has a cross section slightly smaller than that of lower charger 50 and is received therein so that relative movement therebetween can take place. An upper funnel 59 is rigidly mounted on the main frame 24 in alignment above funnel 58 and includes a side opening in which the delivery end of the infeed conveyor 20 is disposed for receiving the compressible material. The lower end of funnel 59 and the upper end of funnel 58 are interconnected by a flexible sleeve 60 so that vertical movement of lower funnel 58 with weighing frame 16 is allowed.

The press head 26 is of rectangular plan configuration corresponding to the configuration of the container 14 and is of such dimensions as to be capable of passing freely through funnels 58 and 59 as well as upper and lower chargers 49 and 50 and the air release sleeve 22.

This structure, except for the air release sleeve, is conventional and is disclosed in U.S. Pat. No. 3,641,734 to Fishburne, the disclosure of which is hereby incorporated by reference.

Although not shown, suitable conventional tobacco distributors can be located in the charger 18 for evenly distributing the tobacco or other compressible material as it falls through the charger from the infeed conveyor. Examples of such distributors are disclosed in U.S. Pat. Nos. 3,595,282 and 3,817,298, the disclosures of which are hereby incorporated by reference.

Figure 3:
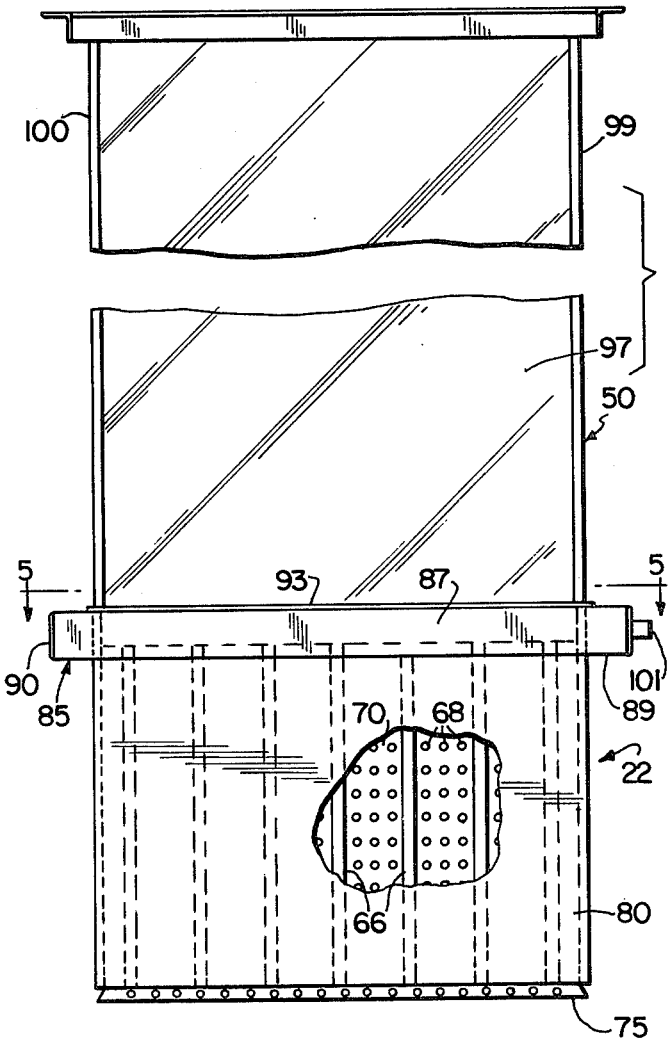
FIG. 3 is an enlarged front elevational view of the air release sleeve shown in FIGS. 1 and 2.
Figure 4:
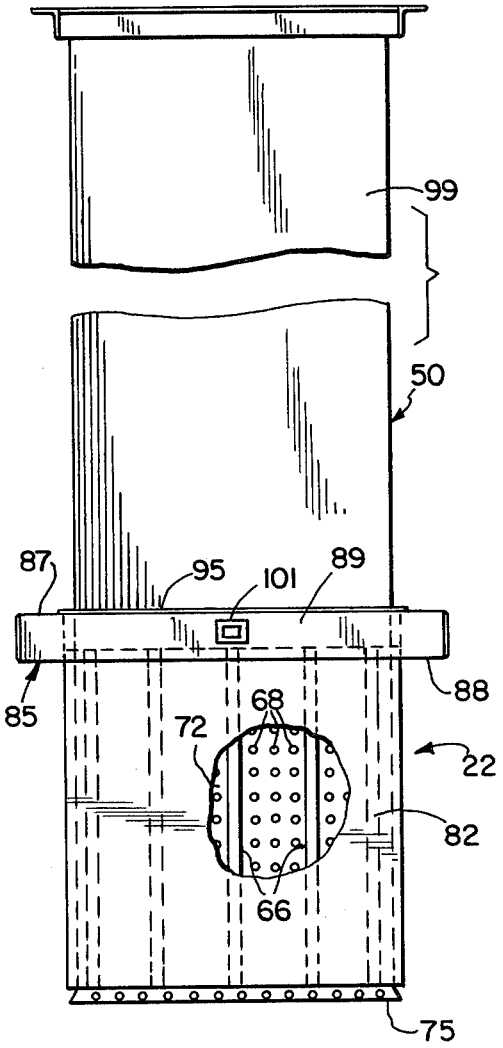
FIG. 4 is a right side elevational view of the air release sleeve shown in FIG. 3.
Figure 5:
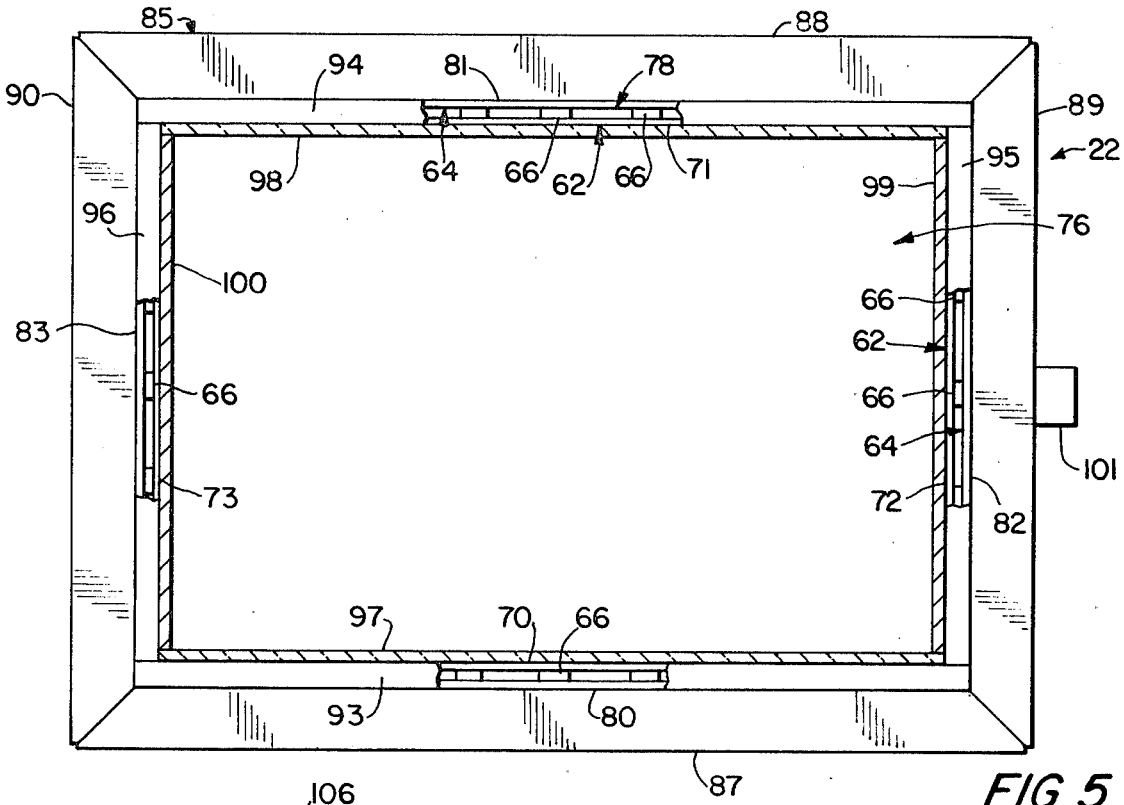
FIG. 5 is an enlarged top plan view in section taken along line 5—5 in FIG. 3.
Figure 6:
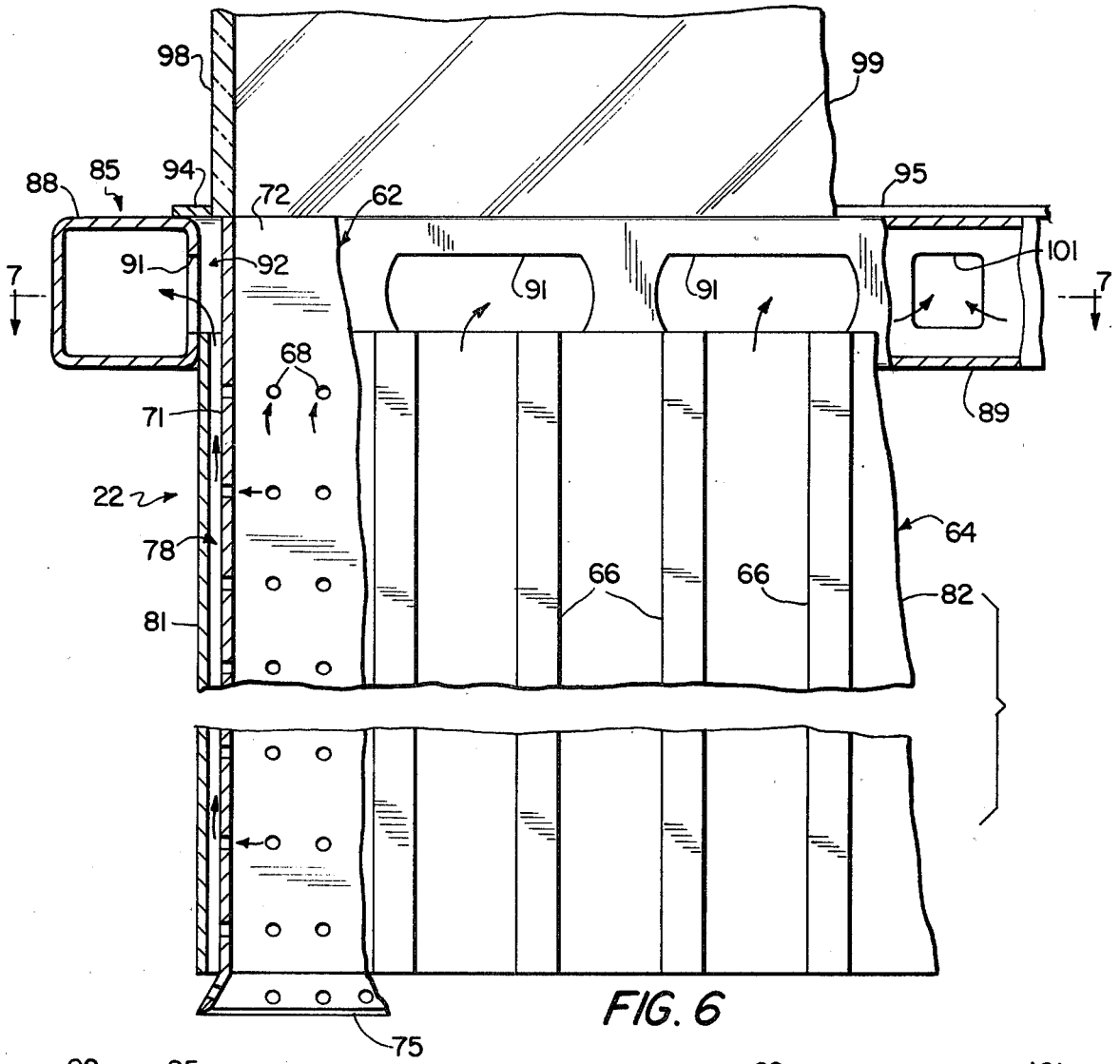
FIG. 6 is an enlarged fragmentary left side elevational view in partial section of the inside of the air release sleeve shown in FIGS. 1-5.
Figure 7:
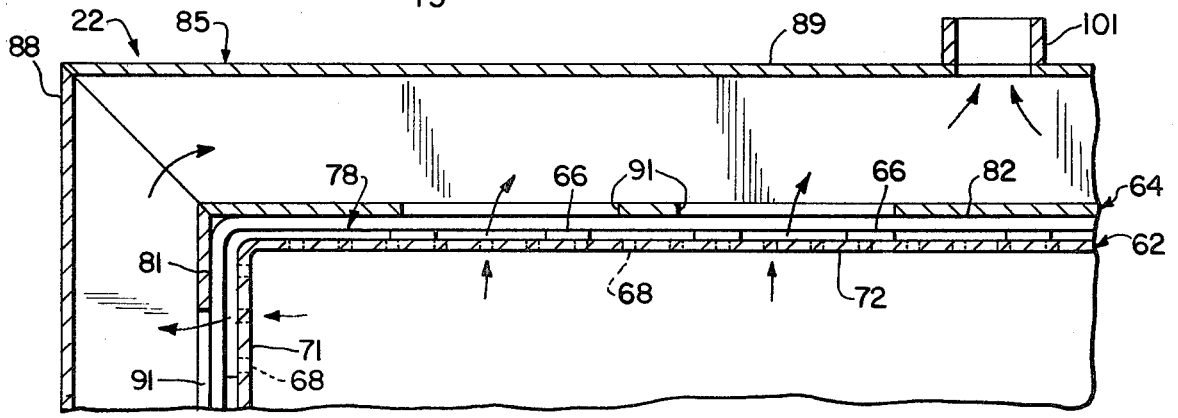
FIG. 7 is a top plan sectional view taken along lines 7—7 in FIG. 6.

Turning now to the details of the air release sleeve 22, as seen in FIGS. 3–7 the sleeve is an open-ended reinforcing device and comprises an inner rigid sleeve 62, an outer rigid sleeve 64 surrounding but being spaced from the inner sleeve, and a plurality of spaced upright reinforcing bars 66 located between and coupled to the inner and outer sleeves. The inner sleeve 62 has a plurality of perforations 68 passing completely therethrough, these perforations advantageously having a diameter of about one-eighth inch and occupying about 30 percent of the surface area of the inner sleeve. The inner sleeve has a smooth inner surface and is comprised of a front wall 70, a rear wall 71, a right side wall 72 and a left side wall 73, which are planar and vertically oriented along the longitudinal axis of the charger 18. Advantageously, these four walls are formed by butt welding only two U-shaped pieces of metal, the corners thereof being rounded and the two welds being located away from the corners. The inner sleeve has at its bottom an outwardly bent skirt 75 integrally formed with the walls, this skirt tapering at an angle of about 15° and extending below the reinforcing bars 66 and the outer sleeve 64, as seen in FIGS. 3, 4 and 6. The four walls comprising the inner sleeve define a rectangular cross section which is slightly smaller than the transverse dimensions of the container 14, these walls defining a cavity 76 which will receive the compressed tobacco therein.

The space between the outer surface of the inner sleeve 62 and the inner surface of the outer sleeve 64 defines an air conducting channel 78, the reinforcing bars being vertically located in this channel and essentially sub-dividing the channel into a plurality of channels for conducting air longitudinally of the air release sleeve 22. The reinforcing bars are advantageously of rectangular cross section and are welded to the inner and outer sleeves. These bars help to prevent outward collapse of the inner sleeve due to the forces of compaction.

As seen in FIGS. 3–7, the outer rigid sleeve 64 is without perforations, i.e., is imperforated, and comprises a front wall 80, a rear wall 81, a right side wall 82 and a left side wall 83 formed by welding two U-shaped members and having rounded corners as done in forming the inner sleeve 62. Walls 80–83 are planar, parallel respectively with walls 70–73 and define a rectangular cross section.

As seen in FIG. 6, the longitudinal length of the reinforcing bars 66 and the outer rigid sleeve 64 are substantially the same and are less than the longitudinal length of the inner sleeve 62.

Coupled to the outside of the walls forming the outer rigid sleeve is a manifold 85 which is formed from four tubular sections 87–90, which communicate with each other to define a continuous passageway surrounding the inner and outer sleeves. The tubular sections are rectangular in cross section and have a plurality of elongated orifices 91 on the inner walls thereof, these orifices facing the portion of the inner sleeve 62 above the outer sleeve and reinforcing bars. These orifices 91 communicate with the air conducting channel 78 defined between the inner and outer sleeves by means of a chamber 92 defined between the tubular sections and the inner sleeve as seen best in FIGS. 6 and 7. The bottom of this chamber is defined by the top of the outer sleeve and the top of the air conducting channel and the top of this chamber is defined by four cover bars 93–96 and four walls 97–100 extending upwardly from the inner sleeve 62. These walls can be reinforced with a plurality of webs, assume a rectangular cross section and form a portion of the lower charger 50 above the air release sleeve 52. Advantageously, the front and rear walls 97 and 98 are formed from transparent plastic so that the operator of the press can observe the distribution pattern of the tobacco as it falls into the sleeve 22.

The manifold 85 collects air via orifices 91 from chamber 92 which in turn receives air moving longitudinally upwardly via the air conducting channel 78 between the inner and outer sleeves.

As seen in FIGS. 3–7, tubular section 89 in manifold 85 has an outlet 101 which, as seen in FIGS. 1 and 2, is connected to a hose or conduit 102 which is in turn connected to a vacuum pump 103. This pump has a conduit 104 connected thereto which is in turn connected to a dust collection unit, not shown. Thus, air collected in the manifold can be conducted away therefrom via outlet 101, hose 102, vacuum pump 103 and conduit 104. With this air will be a substantial amount of tobacco dust which is collected in the collecting unit.

Thus, the air release sleeve 22 forms a reinforcing device for insertion within the container and has coupled thereto an air conducting assembly for conducting air transversely from inside the inner sleeve 62, upwardly longitudinally of the sleeve but not in contact with the sides of the container and then outwardly away from the sleeve above the sides of the container.

In this regard, the manifold is located above the bottom of the inner sleeve a distance substantially equal to the depth of the container as seen in FIGS. 1 and 2 so it does not interfere with the container or the tobacco packed therein.

The air conducting assembly is formed by the perforations 68 in the inner sleeve, the air conducting channel 78 between the inner and outer sleeves, the chamber 92 between the manifold and the inner sleeve, the orifices 91 in the manifold, the passageway defined by the tubular manifold, the outlet 101 in the manifold, hose 102 and pump 103.

OPERATION

In operation, the lower charger 50 with the air release sleeve 22 at the bottom is moved from the position shown in FIG. 1 where it is without the container 14 downwardly to a position as shown in FIG. 2 in which the air release sleeve 22 is received within the container 14. In this position, the manifold is above the top of the container and the skirt 75 is slightly above or rests on the bottom 41 of the container.

Then, pump 103 is activated to withdraw air from the charger 50 as well as the cavity 76 defined by the inner sleeve 62. This air is drawn transversely through the inner sleeve via the perforations, then upwardly longitudinally of the sleeve through the air conducting channel 78, then through chamber 92 and into the manifold 85 via orifices 91. The air is then collected in the manifold and exits the manifold via outlet 101 and is conducted along hose 102 to the vacuum pump 103. The pump then delivers the air with any entrained tobacco dust via conduit 104 to the collection unit.

This withdrawing of air is conducted during the filling operation of the charger with a column of tobacco via infeed conveyor 20 as well as during the compaction step when the press head 26 moves down the charger and compresses the tobacco located in the charger 50 completely into the sleeve 22.

Once the tobacco is fully compacted into the sleeve 22, the ram and sleeve can be raised out of the container.

By operating the pump 103 and thereby conducting the air out of the charger and sleeve, a negative pressure is created in the sleeve and atmospheric pressure exerted on the top of the tobacco in the charger reduces the height of the column of tobacco therein before and while the ram is lowered, which will allow use of shorter chargers, rams and cycle times as well as reducing dust which is collected thereby. In this regard, it is estimated that a charger and ram height savings could be in the range of 10–25 percent. In addition, since the overall charger and ram can be smaller, less structural material is used and less space is required to house the press.

EMBODIMENT OF FIGS. 8 AND 9

Figure 9:
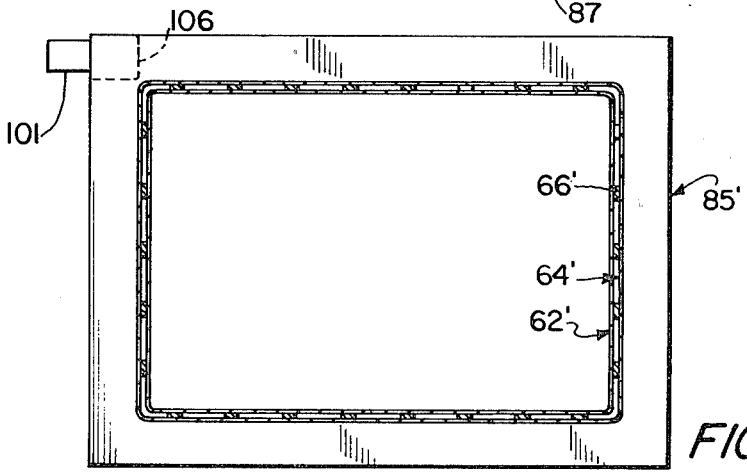
FIG. 9 is a top plan sectional view taken along line 9—9 in FIG. 8.
Figure 8:
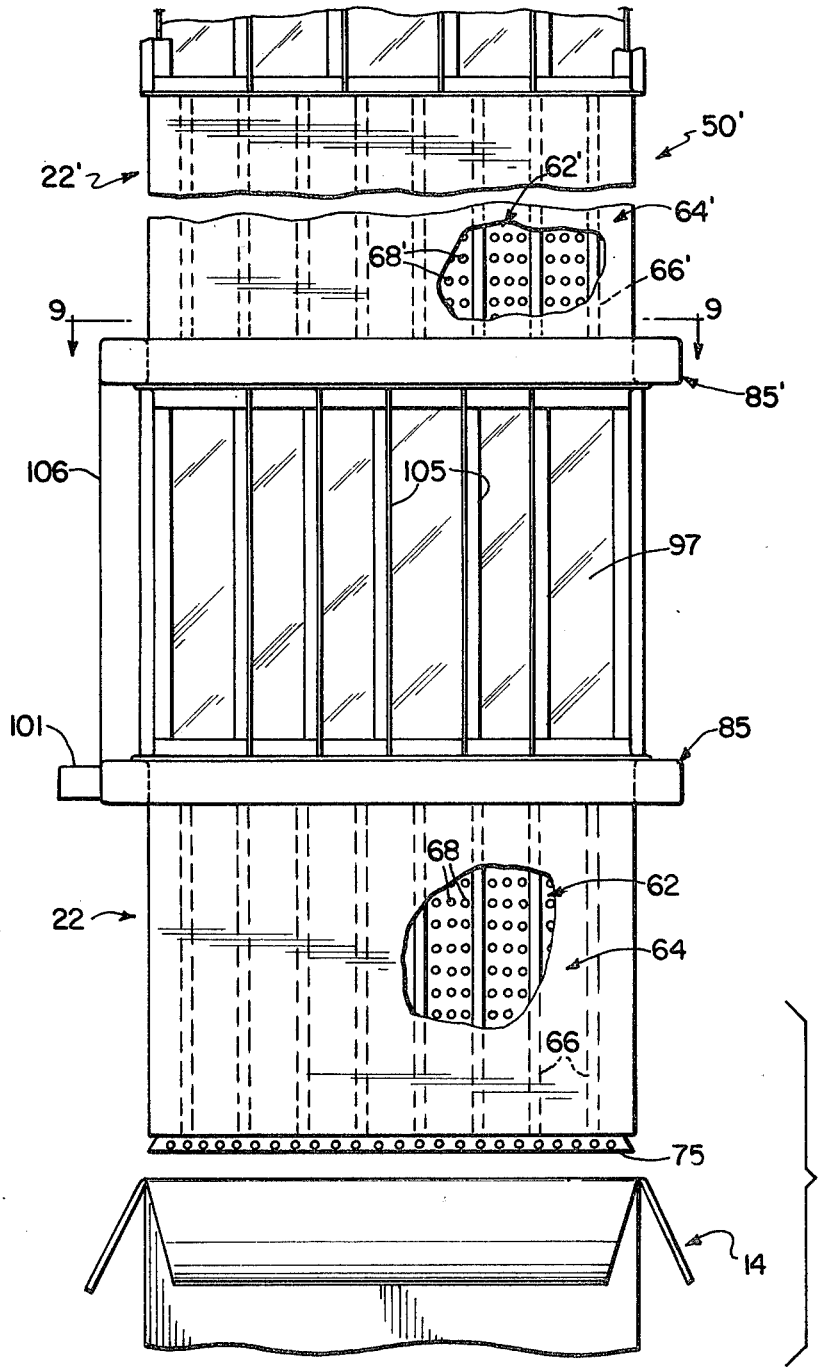
FIG. 8 is a fragmentary front elevational view of a modified charger in accordance with the invention having a pair of air release sleeves located therealong, this charger being utilized with a rectangular case.

A modified embodiment of the invention is shown in FIGS. 8 and 9 which includes a pair of air release sleeves 22 and 22′ located on lower charger 50′. Sleeve 22 is the same as that shown in FIGS. 1–7 and described above and sleeve 22′ is substantially the same as sleeve 22 except that it is inverted and located along the lower charger 50′ spaced above sleeve 22. The space between the sleeves is occupied by a section of the charger similar to walls 97–100 described above with the front and rear walls being of transparent plastic and reinforced with webs 105.

As seen in FIGS. 8 and 9, the second double-walled air release sleeve 22′ includes an inner rigid sleeve 62′ and an outer rigid sleeve 64′, sleeve 62′ having perforations 68′ therein with reinforcing bars 66′ being located between the inner and outer sleeves. Manifold 85′ on the second air release sleeve 22′ is located at the bottom and communicates via vertically oriented tube 106 with manifold 85 on the first air release sleeve 22. Thus, both air release sleeves and manifolds can be connected to a single pump via outlet 101 in manifold 85. Alternatively, tube 106 can be eliminated and each manifold can be connected to separate pumps or various valves could be utilized to activate one or both of the air release sleeves as desired.

In all events, activation of the air conducting assembly in the second air release sleeve 22′ provides additional evacuation of the charger during filling or compaction above the first air release sleeve 22 which is received in the container. As is evident, the skirt 75 on the first air release sleeve 22 is unnecessary in the second air release sleeve 22′.

EMBODIMENT OF FIGS. 10 AND 11

Figure 11:
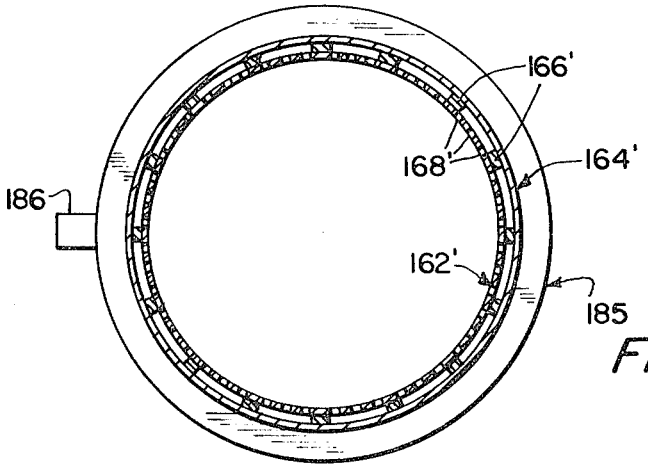
FIG. 11 is a top plan sectional view taken along line 11—11 in FIG. 10.
Figure 10:
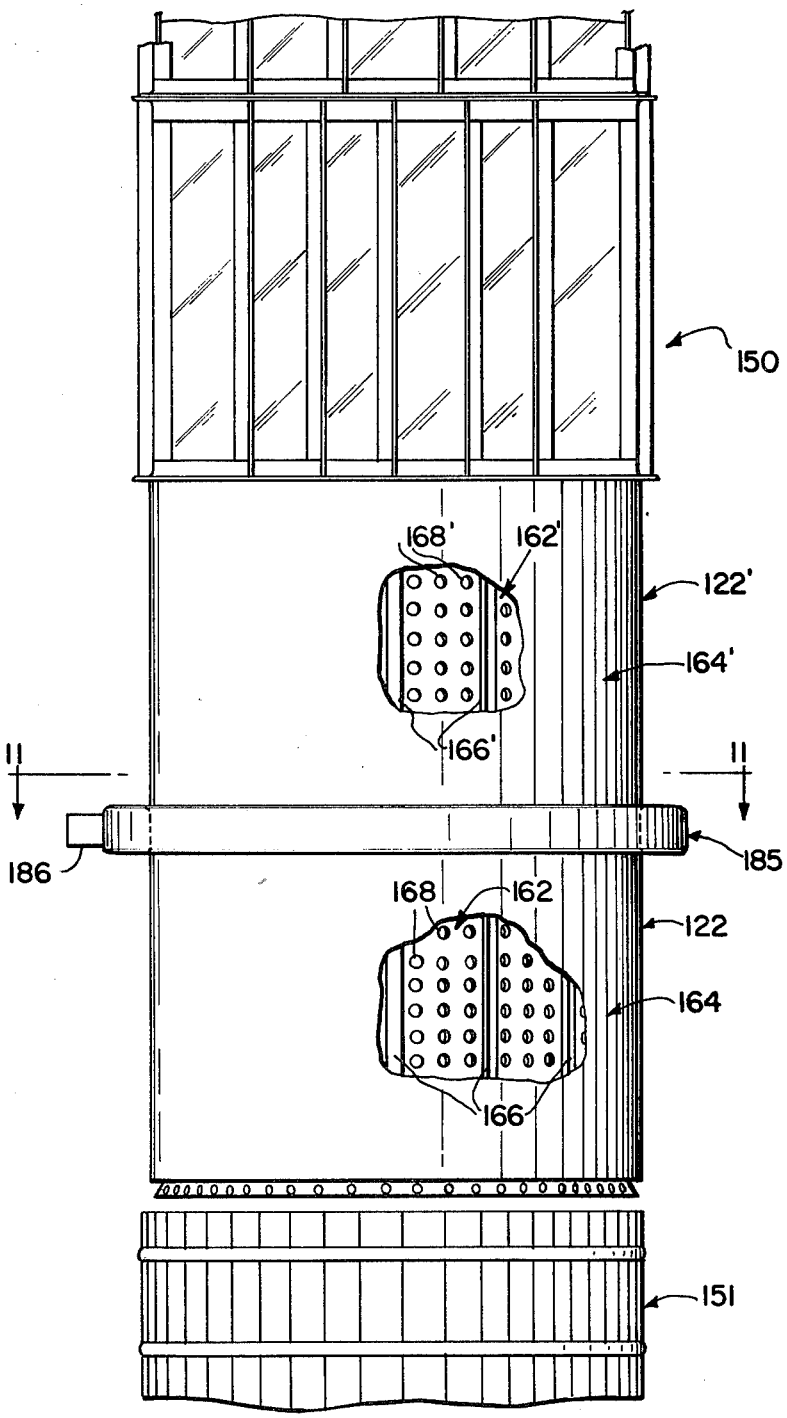
FIG. 10 is a fragmentary front elevational view of another modified charger having a pair of air release sleeves with a common manifold, this charger having a circular cross section and therefore utilized with a cylindrical hogshead.

A third embodiment of the invention is shown in FIGS. 10 and 11 in which the air release sleeves 122 and 122′ have a circular cross section and are used with a lower charger 150 having a circular cross section for packing compressible material into a right cylindrical hogshead 151, which is formed from a plurality of wooden slats connected by wire straps.

Both of the air release sleeves 122 and 122′ are constructed basically the same as air release sleeve 22 and both of these sleeves utilize a common manifold 185 having an outlet 186 for connection to a suitable vacuum pump. Each of the air release sleeves has an air conducting assembly in fluid communication with the manifold 185 for exhausting or withdrawing air from the cavities defined by each of the sleeves. As seen in FIG. 10, the second air release sleeve 122′ is located directly above the first air release sleeve 122, this later sleeve being received in the hogshead 151 and having a longitudinal length substantially equal to the depth of the hogshead.

The two air release sleeves 122 and 122′ have respectively inner rigid sleeves 162 and 162′, outer rigid sleeves 164 and 164′, a plurality of reinforcing bars 166 and 166′ and a plurality of perforations 168 and 168′ passing through the inner sleeves as described above regarding sleeve 22 in FIGS. 1–7.

While various advantageous embodiments have been chosen to illustrate the invention, it will be understood by those skilled in the art that various changes and modifications can be made therein without departing from the scope of the invention as defined in the appended claims.

What is claimed is:

1. In a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising:

means, coupled to said sleeve and activated when said sleeve is within the container, for conducting air transversely from inside said sleeve, upwardly longitudinally of said sleeve but not in contact with the sides of the container, and then outwardly away from said sleeve above the sides of the container, said means for conducting air comprising at least one perforation passing transversely through said sleeve and in air flow communication with the interior and exterior of said sleeve, means, in air flow communication with said at least one perforation and extending longitudinally of said sleeve, for defining an air conducting channel with the exterior of said sleeve, and rigid reinforcement means, engaging the exterior of said sleeve and said means for defining an air conducting channel, for maintaining a space therebetween under the forces of compaction.

2. The improvement according to claim 1, wherein said means for conducting air includes a plurality of perforations passing transversely through said sleeve.

3. The improvement according to claim 1, wherein said means for conducting air includes a pump for positively drawing air out of the inside of said sleeve.

4. The improvement according to claim 1, wherein said means for defining an air conducting channel includes a second rigid sleeve surrounding but spaced from said sleeve.

5. The improvement according to claim 1, wherein said sleeve have a rectangular cross section.

6. The improvement according to claim 1, wherein said sleeve has a circular cross section.

7. The improvement according to claim 1, and further comprising second means, defined in said charger above said sleeve, for conducting air transversely from inside said charger.

8. The improvement according to claim 1, wherein said means for conducting air includes a plurality of perforations passing transversely through said sleeve, and said means for defining an air conducting channel includes a second rigid sleeve surrounding but spaced from said sleeve.

9. In a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising:

means, coupled to said sleeve and activated when said sleeve is within the container, for conducting air transversely from inside said sleeve, upwardly longitudinally of said sleeve but not in contact with the sides of the container, and then outwardly away from said sleeve above the sides of the container, said means for conducting air including a plurality of perforations passing transversely through said sleeve, a second rigid sleeve surrounding but spaced from said sleeve to define an air conducting channel therebetween, and a manifold, coupled to said sleeve, for collecting air from said air conducting channel, said manifold being located above the bottom of said sleeve a distance substantially equal to the depth of the container.

10. The improvement according to claim 9, wherein said means for conducting air further includes an outlet in said manifold, a pump, and a conduit coupled to said outlet and to said pump.

11. In a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising:

means, coupled to said sleeve and activated when said sleeve is within the container, for conducting air transversely from inside said sleeve, upwardly longitudinally of said sleeve but not in contact with the sides of the container, and then outwardly away from said sleeve above the sides of the container, said means for conducting air including a second rigid sleeve surrounding but spaced from said sleeve to define an air conducting channel therebetween, and a plurality of reinforcing bars coupled to and located between said sleeve and said second sleeve, said bars being spaced apart to define air conducting channels therebetween.

12. In a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising:

means, coupled to said sleeve and activated when said sleeve is within the container, for conducting air transversely from inside said sleeve, upwardly longitudinally of said sleeve but not in contact with the sides of the container, and then outwardly away from said sleeve above the sides of the container, said means for conducting air including a second rigid sleeve surrounding but spaced from said sleeve to define an air conducting channel therebetween, and a manifold, coupled to said sleeve, for collecting air from said air conducting channel, said manifold being located above the bottom of said sleeve a distance substantially equal to the depth of the container.

13. The improvement according to claim 12, wherein said means for conducting air further comprises an outlet in said manifold, a pump, and a conduit coupled to said outlet and to said pump.

14. In a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising:

means, coupled to said sleeve and activated when said sleeve is within the container, for conducting air transversely from inside said sleeve, upwardly longitudinally of said sleeve but not in contact with the sides of the container, and then outwardly away from said sleeve above the sides of the container, and second means, defined in said charger above said sleeve, for conducting air transversely from inside said charger, said second means comprising a plurality of perforations passing transversely through said charger, and a second rigid sleeve surrounding but spaced from said charger in the area of said perforations to define an air conducting channel therebetween.

15. The improvement according to claim 14, and further comprising a manifold, coupled to said charger, for collecting air from said air conducting channel.

16. The improvement according to claim 15, and further comprising a second manifold, collecting air from said means for conducting air, and a conduit interconnecting said manifold and said second manifold.

17. The improvement according to claim 15, and further comprising means for connecting said manifold to said charger for collecting air from said means for conducting air.

18. In a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising:

means, coupled to said sleeve and activated when said sleeve is within the container, for conducting air transversely from inside said sleeve and upwardly longitudinally of said sleeve, said means including a manifold, coupled to said sleeve, for collecting air conducted upwardly longitudinally of said sleeve, said manifold being located above the bottom of said sleeve a distance substantially equal to the depth of the container.

19. The improvement according to claim 18, wherein said means for conducting air includes a plurality of perforations passing transversely through said sleeve.

20. The improvement according to claim 18, wherein said means for conducting air further includes pump means, coupled to said manifold, for drawing air out of said sleeve, upwardly of said sleeve, through said manifold and out thereof.

21. In a press for packing loose, compressible material into a container, the press including an upright hollow charger positioned above the container and movable between upper and lower positions, a pressing ram having a press head and being movable downwardly through the charger to compress the material into the container and upwardly to withdraw the ram, an infeed conveyor for delivering the compressible material into the top of the charger, and a rigid sleeve coupled to the bottom of the charger and located within the container when the charger is in the lower position and without the container when the charger is in the upper position, the sleeve having transverse dimensions slightly smaller than those of the container but a cross section similar to that of the container, the improvement comprising:

a plurality of perforations passing transversely through said sleeve;

means, surrounding but spaced from said sleeve, for defining an air conducting channel therebetween;

reinforcement means, located between said sleeve and said means, for preventing outward collapse of said sleeve under compaction pressure; and manifold means, communicating with said air conducting channel, for receiving air therefrom, said manifold means being located above the bottom of said sleeve a distance substantially equal to the depth of the container.

22. The improvement according to claim 21, and further comprising pump means, coupled to said manifold means, for drawing air out of said sleeve through said perforations, upwardly through said air conducting channel, and into said manifold means when said sleeve is within the container.

23. The improvement according to claim 21, wherein said means comprises a second rigid sleeve.

24. In a press for packing loose, compressible material into a container, the press including an upright hollow charger, a rigid compression chamber located at the bottom of the charger and having transverse dimensions slightly smaller than those of the container but a cross section similar to that of the container, a pressing ram having a press head and being movable downwardly through the charger to compress the material into the compression chamber and upwardly to withdraw the ram, and an infeed conveyor for delivering the compressible material into the top of the charger, the improvement comprising:

means, coupled to said compression chamber, for conducting air transversely from inside said compression chamber, upwardly longitudinally of said compression chamber, and then outwardly away from said compression chamber above the sides of the compression chamber, said means for conducting air comprising at least one perforation passing transversely through said compression chamber and in air flow communication with the interior and exterior of said compression chamber, means, in air flow communication with said at least one perforation and extending longitudinally of said compression chamber, for defining an air conducting channel with the exterior of said compression chamber, and rigid reinforcement means, engaging the exterior of said compression chamber and said means for defining an air conducting channel, for maintaining a space therebetween under the forces of compaction.

* * * * *